United States Patent [19]

Braun

[11] Patent Number: 4,893,937

[45] Date of Patent: Jan. 16, 1990

[54] APPARATUS AND METHOD FOR SUSPENDING SOLIDS

[75] Inventor: Ryszard Braun, Rochester, N.Y.

[73] Assignee: Eastman Kodak Company, Rochester, N.Y.

[21] Appl. No.: 213,815

[22] Filed: Jun. 30, 1988

[51] Int. Cl.[4] ..... B01F 15/02

[52] U.S. Cl. ..... 366/136; 366/137; 366/263

[58] Field of Search ..... 366/136, 137, 163, 165, 366/173, 263–265

[56] References Cited

U.S. PATENT DOCUMENTS

| | | | |
|---|---|---|---|
| 1,160,848 | 11/1915 | Conklin | 366/165 X |
| 1,706,418 | 3/1929 | Sissom | 366/173 X |
| 2,365,293 | 12/1944 | Robinson | 366/136 X |
| 2,391,858 | 1/1946 | Auer | 366/136 |
| 3,661,364 | 5/1972 | Lage | 366/136 |
| 4,007,921 | 2/1977 | Zingg | 366/136 X |
| 4,200,228 | 4/1980 | Woerpel | 239/25 |
| 4,208,375 | 6/1980 | Bard | 366/265 X |
| 4,332,484 | 6/1982 | Peters | 366/137 |
| 4,410,279 | 10/1983 | Howden et al. | 366/264 X |
| 4,534,654 | 8/1985 | Alt et al. | 366/137 |
| 4,569,756 | 2/1986 | Klein | 366/336 X |
| 4,637,217 | 1/1987 | Owen et al. | 62/74 |

FOREIGN PATENT DOCUMENTS

| | | | |
|---|---|---|---|
| 764148 | 12/1956 | United Kingdom | 366/137 |
| 890285 | 2/1962 | United Kingdom | 366/137 |

*Primary Examiner*—Stephen Marcus
*Assistant Examiner*—Christine A. Peterson
*Attorney, Agent, or Firm*—J. Jeffrey Hawley

[57] ABSTRACT

There are disclosed apparatus and methods for mixing solids that are difficult to mix. The apparatus includes means for providing a slurry of the solid to be mixed to the inlet side of a centrifugal recirculating pump.

6 Claims, 1 Drawing Sheet

APPARATUS AND METHOD FOR SUSPENDING SOLIDS

FIELD OF THE INVENTION

The present invention relates to mixing solids in liquids in order to produce a suspension of the solid.

DESCRIPTION RELATIVE TO THE PRIOR ART

As noted, the present invention is directed to providing suspensions of solids, particularly those that are difficult to suspend. While the preferred embodiment is directed to the suspending of dried microorganisms, it is not so limited. The invention is useful to suspend any suspendable solid.

In U.S. Pat. No. 4,200,228 there is disclosed a method for the making of snow whereby microorganisms are included in droplets that are sprayed into the air. The microorganisms that are used are of the type which are known to promote ice nucleation. As a result, snow can be made at temperatures that are much higher than are ordinarily possible. A typical microorganism that is useful in this method is a Pseudomonad and particularly *Pseudomonas syringae.*

In U.S. Pat. No. 4,637,217 there is disclosed a method for accelerating the freezing of sea water. Ice nucleating microorganisms are added to the water source, in this case sea water. The sea water is then distributed, such as by spraying, to make large ice structures. These ice structures are useful for oil drilling platforms in the polar regions. In this application of the ice nucleating microorganisms, the conditions of spraying are adjusted to promote the formation of ice on the surface rather than snow in the air. In addition to spraying, the patent also discloses other methods of distributing the ice nucleated sea water. For example, an area that is surrounded by a dam can be flooded by the nucleated sea water and allowed to freeze.

The water that is used in snow making is usually from an on site source such as a pond or stream. The water is pumped up the ski slope to the snow guns using large pumps. These pumps are inside enclosures in order to protect them from the weather and to facilitate maintenance.

Whether to make snow or to make large ice structures, the ice nucleating microorganism is usually delivered to the site in dried form. The microorganism is then resuspended in an aqueous medium, typically just water, in a concentrated form. This concentrate is mixed in a tank in the structure that contains the pumps for distributing the water to the ice making system. Since only a small amount of the microorganism is needed to nucleate the source water, only a small amount of this concentrate needs to be injected into the water supply. In a typical installation, a 100 liter suspension of microorganism having a microorganism concentration of 3 g/L will nucleate about 380,000 liters of water and will last for about 10 hours before the tank will need to be refilled with new suspension.

Thus, there is a need to suspend quantities of dried microorganism. A typical method is to introduce the dried solid into the tank and then to activate a recirculating system. The recirculation system is equipped with a pump that is capable of pumping the suspension at a rate that results in a turnover of about two tank volumes per minute. This high turnover and turbulence associated with the pump tends to mix and suspend the microorganism. In another method, the container holding the suspension is stirred with a conventional motor driven impeller.

However, in these prior art methods, problems were encountered with the suspension. Large particles still tended to settle at the bottom of the container and filters in the discharge line from the container tended to fill rapidly. Prior to the present invention, the need for an improved method of suspending the microorganisms was apparent.

SUMMARY OF THE INVENTION

In accordance with the present invention, there is provided an improved mixing apparatus for use with a container of liquid, the apparatus comprising a centrifugal recirculating pump having inlet means for receiving liquid from a container and discharge means for delivering liquid to such container. The improvement is that there is provided means for introducing a slurry of highly concentrated solids to said inlet means from a source that is separate from the container.

In another aspect of the invention, there is provided a method of preparing a suspension of solids, comprising the steps of:

(a) preparing a highly concentrated slurry of said solids, (b) preparing a container of liquid of a volume substantially greater than the volume of said slurry, (c) recirculating said liquid volume through a centrifugal pump, and (d) adding said highly concentrated slurry to said recirculating water at the inlet side of said pump, thereby forming a suspension of said solids in said container.

DETAILED DESCRIPTION OF THE INVENTION

Figure 1:
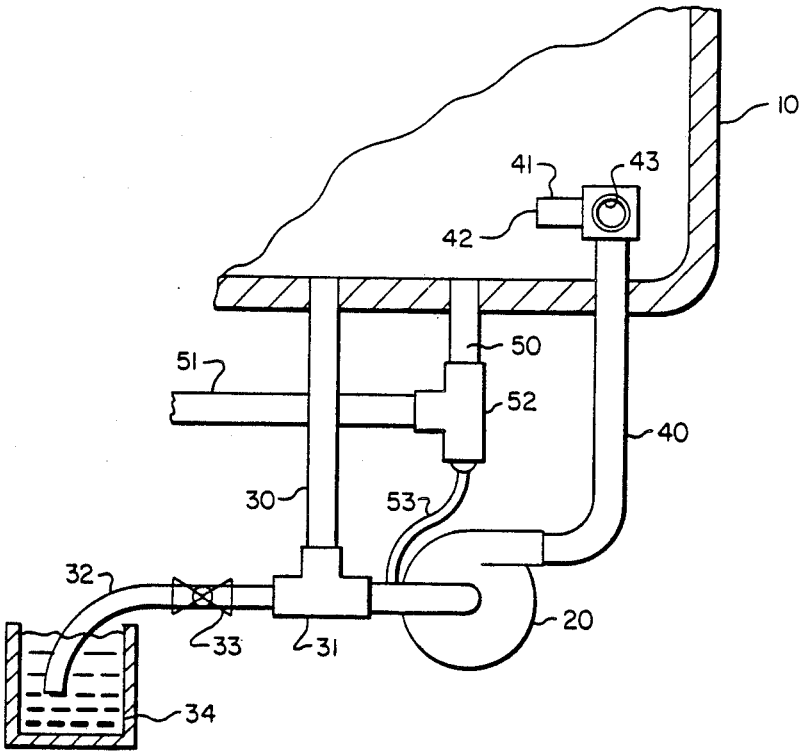
FIG. 1 is a partially schematic representation of the suspending apparatus of the invention.

The present invention can be understood from FIG. 1. There is illustrated a mixing and storing container for the suspension shown in cut away section at 10. Attached to the bottom of container 10 is an inlet line 30 for a centrifugal recirculating pump 20. To the discharge side of pump 20 is discharge line 40 having a discharge nozzle generally shown at 41. Discharge nozzle 41 is located inside container 10 and is described more fully below.

Also attached to the bottom of container 10 is discharge line 50 for discharging the suspension to the injection system (not shown) for the snow or ice making equipment. The discharge line 50 includes a solids trap 52. The function of the trap 52 and the line 53 will be described in more detail below.

In accordance with the present invention there is provided means for providing a slurry of the solid to be suspended to the inlet side of the recirculating pump. The means in this embodiment includes a "T" fitting 31 in the intake line 30. To one of the openings in the "T" is attached line 32 having a valve 33.

In operation, the container 10 is filled with the liquid into which the solid is to be suspended. A highly concentrated slurry of the solid is prepared in container 34. The recirculating pump 20 is activated, the line 32 is placed into container 34 and valve 33 is opened. The slurry is transported through line 32 into inlet line 30 and thereafter into pump 20 and finally through line 40 into container 10.

I have found that forming a thick slurry and passing the slurry through pump 20 finely divides the solids and the result is a thorough suspension of the solids. Such thick slurries can be in a concentration of from about 25 to about 150 grams per liter, preferrably about 85 grams per liter. This is in contrast to the suspension where the concentration of solids is typically about 2 to 6 grams per liter.

In preferred embodiments, the discharge line 40 is connected to a discharge nozzle 41 inside the container 10. The nozzle 41 includes a discharge 43 to discharge recirculating suspension generally parallel to the tank wall and a discharge 42 to discharge recirculating suspension generally perpendicular to the tank wall. This arrangement of discharge substantially eliminates vortexing in the container and improves the suspension of the solids.

In the comparison described below, the invention was practiced using the following equipment: The container 10 was a 750 liter tank. The recirculating pump operated at 3400 rpm and had a capacity of about 380 liters per minute. Inlet line 30 and discharge line 40 were about 3.75 cm in diameter while line 32 was about 1.25 cm in diameter. Nozzle 43 was a 1.90 cm opening while nozzle 42 was a 1.25 cm opening.

To illustrate the improvement attained with the invention, 1500 grams of microorganism was placed in about 20 liters of water in container 34. Container 10 was filled with about 480 liters of water and pump 20 was activated. Then, line 32 was placed in the slurry and valve 33 was opened. In about 2 minutes, container 34 was empty and the container 10 was full of suspended microorganism at a concentration of about 3 grams per liter. To test the quality of the suspension, the resulting suspension was poured over a large black surface having a drain. The milky white suspension went down the drain leaving behind only small amounts of solids.

In comparison, the same apparatus was used except the 1500 grams of microorganism were added by pouring the solids into the top of container 10 in the conventional manner. Valve 33 was closed. The recirculation pump 20 was activated for 15 minutes and the resulting suspension tested as before. As the suspension drained, a white film was left behind on the black surface indicating incomplete suspension of the microorganism. Thus, the apparatus and method of the invention provides faster and more complete suspension of the microorganism.

While the present invention is an improvement over the art, if the container is allowed to stand for long periods, some settling of microorganism will occur. Further, it is desirable to circulate the susepension in the container 10 periodically so as to eliminate any localized increase in temperature that might occur. Thus, it is common to activate the recirculating pump 20 for about 1 minute every hour. During the remainder of the hour, suspension is continuously removed through discharge line 50 at a rate of typically 1 liter per minute for injection into the snow or ice making water supply. I have found it desirable to provide a trap 52 in this discharge line. Any solids that might settle out while the recirculating pump is not operating are collected in trap 52. When recirculating pump 20 is activated, the collected solids are drawn from trap 52 into the intake line 30 through line 53. Thus, the settled solids are resuspended.

The invention has been described in detail with particular reference to preferred embodiments thereof, but it will be understood that variations and modifications can be effected within the spirit and scope of the invention.

I claim:

1. In mixing apparatus for use with a container of liquid, the apparatus comprising a centrifugal recirculating pump having inlet means for receiving liquid from a container and discharge means for delivering liquid to such container, the improvement wherein there is provided means for introducing a slurry of highly concentrated solids to said inlet means from a source that is separate from the container.

2. The apparatus according to claim 1 wherein said discharge means includes nozzle means for discharging liquid both generally parallel to the wall of such a container and generally perpendicular to the wall of such a container.

3. A method of preparing a suspension of solids, comprising the steps of:

(a) preparing a highly concentrated slurry of said solids, (b) preparing a container of liquid of a volume substantially greater than the volume of said slurry, (c) recirculating said liquid volume through a centrifugal pump, and (d) adding said highly concentrated slurry to said recirculating water at the inlet side of said pump, thereby forming a suspension of said solids in said container.

4. A method according to claim 3 wherein said solids are dried microorganisms.

5. A method according to claim 3, wherein the concentration of said slurry is between about 25 and 150 grams per liter.

6. A method according to claim 3 wherein said suspension is used to nucleate water for snowmaking.

* * * * *